US011167404B2

(12) United States Patent
Gurt

(10) Patent No.: US 11,167,404 B2
(45) Date of Patent: Nov. 9, 2021

(54) SEPARABLE ROTARY TABLE

(71) Applicant: FIBRO GMBH, Weinsberg (DE)

(72) Inventor: Juergen Gurt, Weinsberg (DE)

(73) Assignee: FIBRO GMBH, Weinsberg (DE)

( * ) Notice: Subject to any disclaimer, the term of this patent is extended or adjusted under 35 U.S.C. 154(b) by 282 days.

(21) Appl. No.: 16/348,275

(22) PCT Filed: Nov. 2, 2017

(86) PCT No.: PCT/EP2017/078001
§ 371 (c)(1),
(2) Date: May 8, 2019

(87) PCT Pub. No.: WO2018/137802
PCT Pub. Date: Aug. 2, 2018

(65) Prior Publication Data

US 2019/0314976 A1 Oct. 17, 2019

(30) Foreign Application Priority Data

Jan. 27, 2017 (DE) ..... 102017101620.1

(51) Int. Cl.
*B25H 1/14* (2006.01)
*B25H 1/08* (2006.01)

(52) U.S. Cl.
CPC ..... *B25H 1/14* (2013.01); *B25H 1/08* (2013.01)

(58) Field of Classification Search
CPC ... B25H 1/02; B25H 1/08; B25H 1/14; B25H 1/0021; E21B 3/04; E21B 7/021; E21B 3/045; E21B 3/06; B25B 11/00; B25B 11/02; B25B 13/36; F16C 19/10; F16C 19/22; F16C 19/305; F16C 19/54;
(Continued)

(56) References Cited

U.S. PATENT DOCUMENTS 1,357,707 A * 11/1920 Helm ..... E21B 19/16 81/57.15
2,574,914 A 11/1951 Du Bois
(Continued)

FOREIGN PATENT DOCUMENTS

DE 202011103882 U1 12/2011

OTHER PUBLICATIONS

International Search Report dated Feb. 26, 2018 issued in PCT/EP2017/078001.
(Continued)

*Primary Examiner* — Joseph J Hail
*Assistant Examiner* — Timothy B Brady
(74) *Attorney, Agent, or Firm* — Scully Scott Murphy and Presser

(57) ABSTRACT

The invention relates to a rotary table (1) for positioning a workpiece by means of a manual drive (4*a*, 4*b*), said rotary table comprising a base plate (2) having a base plate-side transmission device (20), and also comprising a bearing plate (3), mounted rotatably on the base plate and having a bearing plate-side transmission device (30), which is configured to rotate the bearing plate (3) relative to the base plate (2) by means of a drive (4), wherein the base plate (2) is formed as a two-part or multi-part component composed of at least two plate segments (2*a*, 2*b*), and wherein the bearing plate (3) is formed as a two-part or multi-part component composed of at least two plate segments (3*a*, 3*b*).

16 Claims, 3 Drawing Sheets

Figure 1:
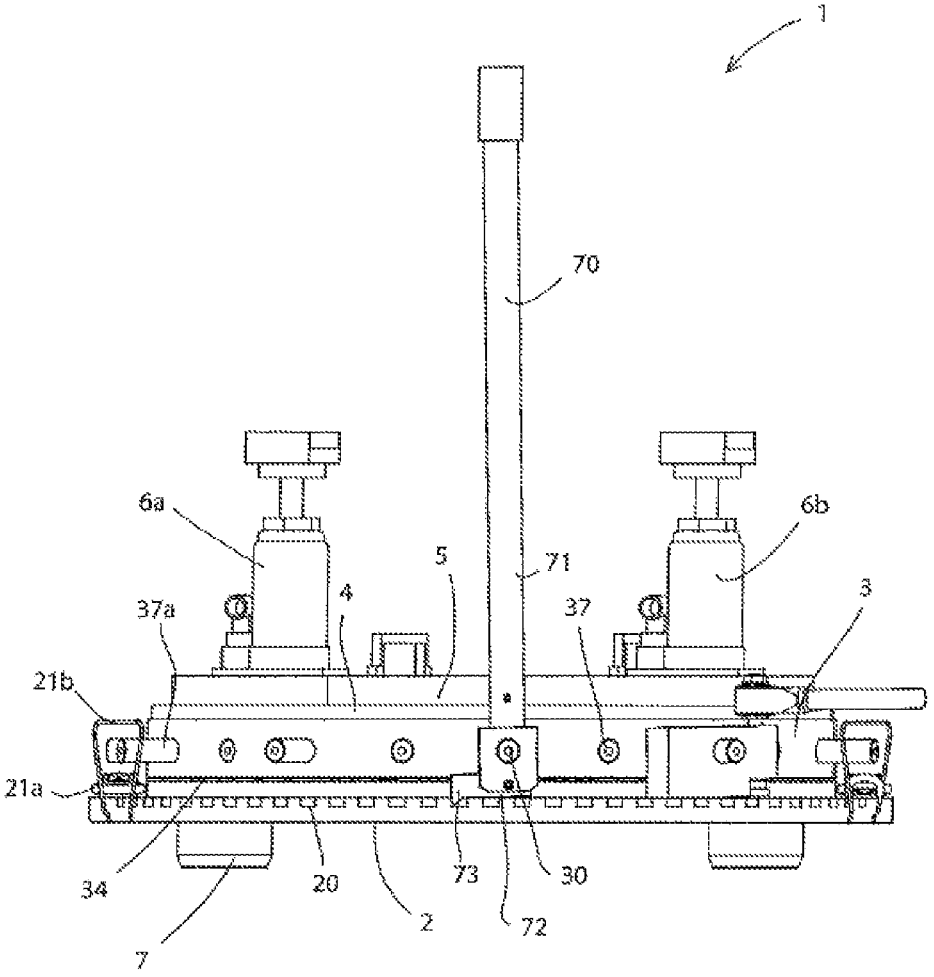

(58) Field of Classification Search
CPC ..... F16C 33/46; F16C 33/48; F16C 19/28; F16C 19/38; F16C 19/496; F16C 19/546; F16C 33/523; F16C 33/526; F16C 19/48; B23Q 1/00; B23Q 1/25; B23Q 16/06; B23Q 16/10; B23Q 16/102; B23Q 2220/004; B23Q 3/00; B23Q 3/06
USPC ..... 269/55–57, 63, 289 R, 302.1; 81/57–57.37; 384/504, 517, 543
See application file for complete search history.

(56) References Cited

U.S. PATENT DOCUMENTS 2,718,440 A * 9/1955 Brinkmann ..... F16C 33/526 384/606
3,086,409 A 4/1963 Budney et al.
4,015,661 A * 4/1977 Christensen ..... E21B 19/164 166/77.53
8,397,648 B1 * 3/2013 Palladino ..... A47B 37/04 108/42
2003/0047332 A1 * 3/2003 Merrick ..... B25H 1/0021 173/31
2008/0264755 A1 * 10/2008 Kobs ..... B65G 47/71 193/37
2014/0306391 A1 * 10/2014 Eichhammer ..... F16P 1/02 269/57
2015/0283660 A1 * 10/2015 Cassidy ..... B23P 6/002 409/205
2017/0121146 A1 * 5/2017 McGonagle ..... B65H 49/28

OTHER PUBLICATIONS

English language translation of International Search Report and Written opinion dated Feb. 26, 2018 issued in PCT/EP2017/078001 previously submitted on May 8, 2019.

* cited by examiner

SEPARABLE ROTARY TABLE

The invention relates to a rotary table according to the features of Claim 1.

Rotary tables for positioning a workpiece that comprise a clamping plate and a base, the clamping plate being mounted on the base so as to rotate about a vertical axis and being driven by a drive, are already known in the prior art.

Such known rotary tables generally have a clamping plate for receiving the workpiece, which clamping plate is mounted on a substructure so as to rotate about a vertical axis. To position the workpiece situated on the clamping plate, the clamping plate is rotated about the vertical axis by a rotational movement generated by a drive. Said drive drives the clamping plate directly or indirectly, for example via gears or a belt drive.

However, there are applications in which the assembly of the rotary table, in particular around a central component, can be achieved only with great effort, and the assembly of conventional rotary indexing tables presents a real challenge.

For example, in the case of wellbore drilling, e.g. for oil rigs or for oil extraction, motors must be attached to the drill rigs; in the current state of the art, these motors are moved by means of handling tools, such as a crane, into the correct mounting position and are rotated until the connecting flange between motor and drill is in an appropriate mounting position.

Classic rotary tables, which are typically designed with high precision for a high number of reproducible rotations, are excluded for cost reasons when only a small number of rotations are required and when particularly high rotational accuracy may not even be required.

It is therefore an object of the present invention to provide a low-cost rotary table, with which large loads (for example, up to 30 tons) can be reliably moved, and which can be assembled easily with low assembly effort, even in complex assembly situations.

This object is achieved by a rotary table having the features of Claim 1. According to a basic concept of the present invention, a rotary table is embodied as a divided rotary table, in which both the base plate and the bearing plate, which is rotatably mounted on the base plate, are configured as comprising two or more parts.

According to the invention, a rotary table for positioning a workpiece by means of a manual drive is therefore proposed, said rotary table comprising a base plate having a base plate-side transmission device, and also comprising a bearing plate, mounted rotatably on the base and having a bearing plate-side transmission device, which is configured to rotate the bearing plate relative to the base plate by means of a drive, the base plate being formed as a two-part or multi-part component composed of at least two plate segments and the bearing plate being formed as a two-part or multi-part component composed of at least two plate segments.

According to the invention, the rotary table is preferably further configured such that it can be actuated by means of a manual drive, in particular by means of a manual ratchet.

In one advantageous embodiment of the invention, the base plate is formed from two separate plate segments, which are connected to one another via locking means. In a particularly advantageous embodiment, the plate segments of the base plate are formed hermaphroditically from two identical plate segments, as it were, which are connected to one another on the face side or on the support-surface side via locking means.

Particularly suitable as locking means are clamp locking means and quick-release locking means, in which a spring clip is arranged on one of the plate segments and engages in a suitably corresponding retaining bracket on the other plate segment and can be manipulated from a preassembly position to a final assembly position in which the two plate segments are held together under spring tension.

In a further advantageous embodiment of the invention, the base plate is configured as a cylindrical plate having a central circular opening. In other words, with a two-part base plate, each plate segment supplies a semicircular opening which together create said central circular opening when the two plate segments are joined to form the base plate.

It is further advantageous for the bearing plate to also be configured as a cylindrical plate having a corresponding central opening, which preferably has the same or nearly the same diameter as the central opening in the base plate.

It is likewise advantageous for the bearing plate, which is mounted rotatably on the base plate, to be held on the base plate via a radial bearing, which is advantageously achieved by a radial bearing protruding outward from the underside of the bearing plate around the central opening thereof, and extending into the central opening of the base plate. This ensures that the rotary bearing elements of the radial bearing bear against the face-side inner surface of the central opening of the base plate, ensuring a radial support of the bearing plate.

It is further advantageously provided that each of the plate segments that form the bearing plate is configured as a bearing cage having a plurality of bearing rollers that protrude outward from the plate plane on the underside of the bearing plate. In this way, the bearing rollers of the bearing plate bear against the upper side of the base plate and can be rotated about the axis of rotation that passes through the central openings in the base plate and in the bearing plate.

In a further advantageous embodiment of the invention, each bearing cage forms a plurality of radially extending rows of through openings, arranged one behind the other and spaced from one another, in which the bearing rollers are respectively mounted. The bearing rollers thus extend in concentric circles, so that a particularly good rotatable mounting is ensured.

It is further advantageously provided for each of the bearing rollers arranged one behind the other in a row to be mounted on the bearing plate on a radially installed shaft, said shaft preferably extending up to the edge face of the bearing plate and through a corresponding opening in the bearing plate. Further preferably, the shaft also extends beyond the edge face of the bearing plate and protrudes with a shaft section projecting on the edge-face side from the bearing plate. This shaft section is a part of the bearing plate-side transmission device. The base plate-side transmission device is advantageously configured as a ring gear, which is formed along the edge of the upper side of the base plate. The diameter of the bearing plate is advantageously selected such that it extends no further than the edge of the ring gear of the base plate beneath it. In other words, this means that the base plate protrudes beyond the edge of the bearing plate supported upon it by such a section, which forms the base plate-side transmission device in the form of a ring gear.

In a further advantageous embodiment of the invention, the rotary table is configured to comprise a manual ratchet equipped with a lever arm and a ratchet member, the ratchet member being fastened to or mounted on the bearing plate-side transmission device, preferably on the shaft sections or bolts protruding from the edge face. By manipulating the manual ratchet about a radially extending rotational axis, i.e. a rotational axis about the shafts that hold the bearing rollers in their assembled position, the ratchet member is engaged into the teeth on the base plate side. By manipulating the manual ratchet about the aforementioned rotational axis, the bearing plate is rotated on the base plate by a corresponding angle. Thus, by repeated ratcheting with the ratchet member, the bearing plate can be rotated by the desired angle on the base plate. It is particularly advantageous for a stop to be provided at the edge face end of the shaft sections that protrude beyond the bearing plate on the edge face, which stop secures the ratchet member of the manual ratchet mounted on said shaft sections against slippage, in particular against radial slippage.

In a further advantageous embodiment of the invention, the plate segments of the base plate and/or the plate segments of the bearing plate are configured as hermaphroditic plate segments.

In a likewise advantageous embodiment of the invention, an at least two-part cover plate having a likewise central opening is provided on the bearing plate. According to the invention, it can further be provided that above the bearing plate, for example on the cover plate, an integral support plate having a likewise central opening is provided, said central opening extending on one side up to the edge of the support plate with an opening width that corresponds substantially to the diameter of the central opening, resulting in an approximately U-shaped plate overall.

On the support plate, a lifting device is advantageously provided, which preferably consists of two lifting cylinders, which are further preferably arranged symmetrically to the central opening on the support plate. In other words, the device according to the invention provides a rotary lifting device, which can be rotated manually or mechanically about a rotational angle and with which a raising or lowering movement can be carried out by means of the lifting device, simultaneously or with staggered timing, depending upon the direction of actuation of the lifting cylinder.

In a further advantageous embodiment of the invention, on the underside of the base plate a plurality of feet are mounted, which preferably have a cylindrical shape and further preferably protrude with at least one foot segment beyond the edge of the base plate. This ensures that the rotary table can be mounted in mounting holes provided on a base or a base surface, thereby guaranteeing a rotationally stable position of the rotary table. The protrusion of the feet beyond the base plate allows a rotary table to be mounted more easily in such base-side openings, since the view of the feet is not obstructed.

Other advantageous refinements of the invention are characterized in the dependent claims and will be described in greater detail in the following, in conjunction with the description of the preferred embodiments of the invention, with reference to the figures.

Figure 2:
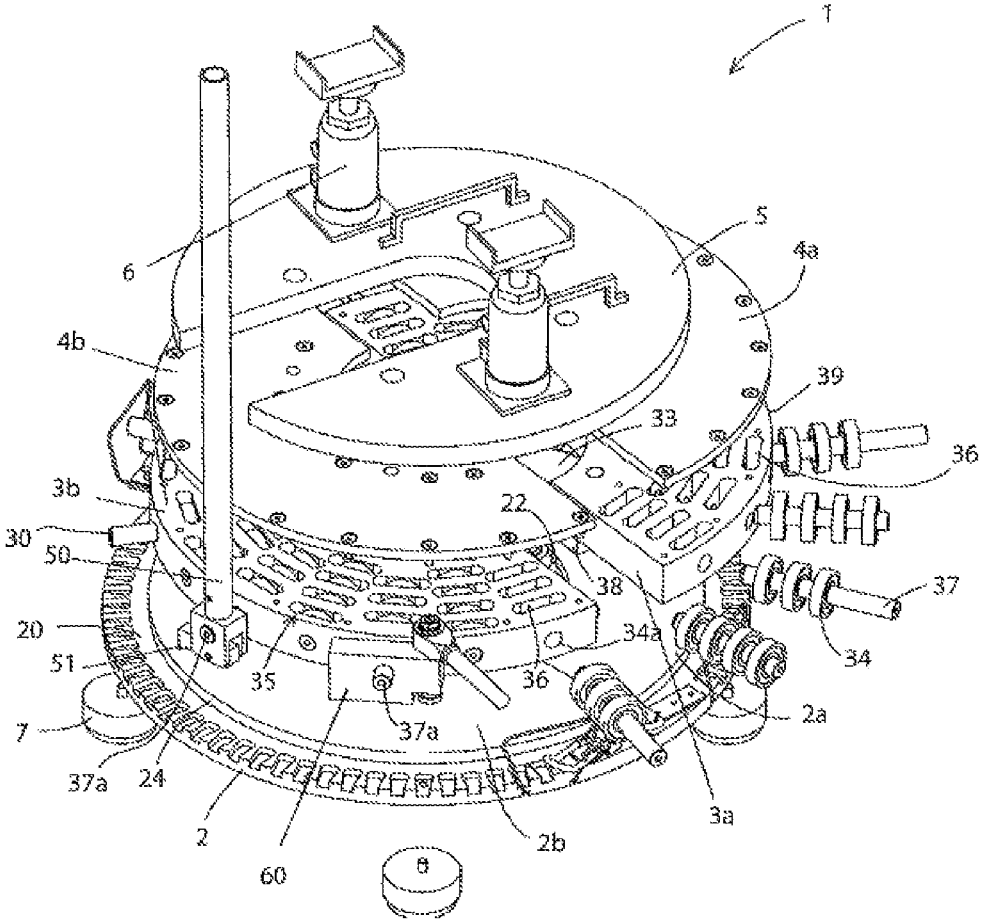
Figure 3:
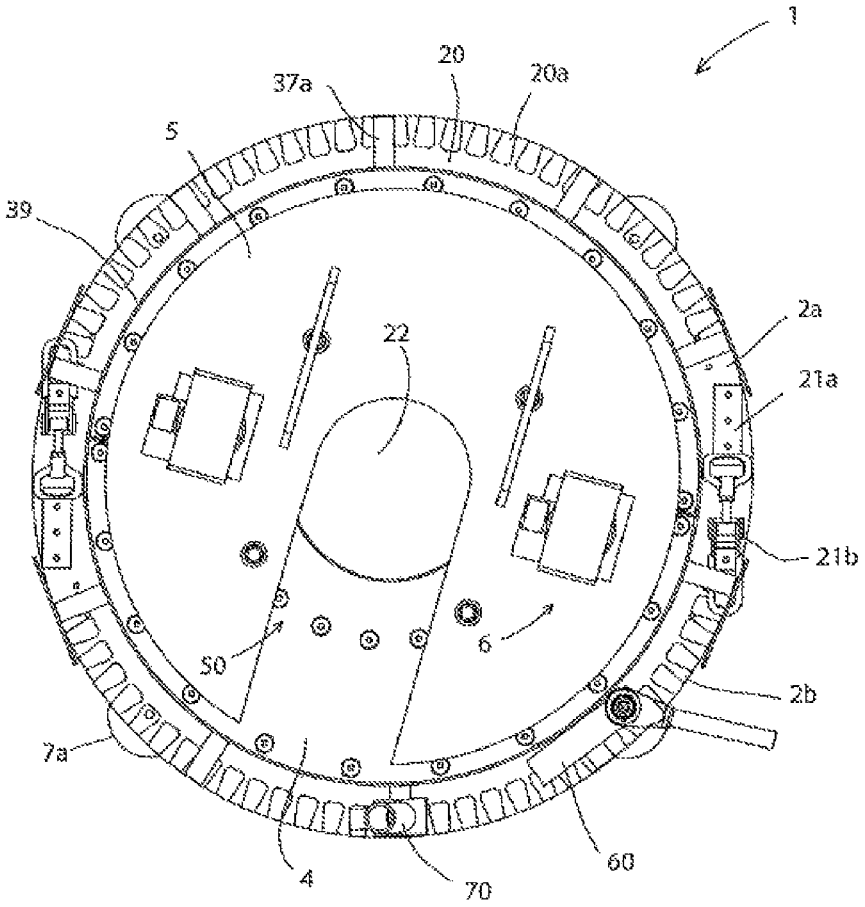

In the drawings,

FIG. 1 is a side view of an exemplary embodiment of a rotary table according to the invention, FIG. 2 is a perspective view of the rotary table of FIG. 1, and FIG. 3 is a plan view of the rotary table of FIG. 1.

In the following, the invention will be explained in greater detail with reference to FIGS. 1 to 3, wherein like reference numerals refer to the same functional and or structural features.

An exemplary rotary table 1 for manual positioning of a workpiece is shown in FIGS. 1 to 3. The rotary table comprises a base plate 2, a bearing plate 3 supported on the base plate 2, a cover plate 4 mounted on the bearing plate 3, and a support plate 5 mounted on the cover plate 4.

Base Plate 2

In the following, base plate 2 will be described in greater detail. Base plate 2 rests on feet 7, which are mounted on the underside of the base plate. As is clear in particular from FIG. 3, a foot segment 7*a* projects outward beyond the outer periphery of base plate 2. Base plate 2 is composed of two plate segments 2*a*, 2*b*, with base plate 2 being configured as a cylindrical plate having a central opening 22. Each of the two plate segments 2*a*, 2*b* makes up one-half of the cylindrical plate 2. As is clear from FIG. 3, the two plate segments 2*a*, 2*b* are connected to one another by a locking means 21*a*, 21*b*. Locking means 21*a*, 21*b* is a spring-loaded bracket-type locking means, in which one retaining element 21*a* is attached to one plate segment 2*a* and the other retaining element 21*a* is attached to the other plate segment 2*b*. Corresponding locking brackets 21*b* are attached opposite one another on the respectively other plate segment 2*a* or 2*b*. As is further clear from FIGS. 1 to 3, on the upper side of the base plate 2, along the outer periphery thereof, a base plate-side transmission device 20 in the form of a ring gear is formed. Ring gear 20 forms a plurality of teeth 20*a*, arranged side by side and open outwardly. Teeth 20*a* have an outwardly decreasing tooth width. In the area of the ring gear, base plate 2 has a smaller thickness than in the remaining region, as is clear from step 24 in FIG. 2.

Bearing Plate 3

In the following, bearing plate 3 will be described in greater detail. Bearing plate 3 is likewise composed of two plate segments, i.e. the plate segments 3*a*, 3*b*. At the center of bearing plate 3 is a central opening 33. Around central opening 33, a radial bearing 34 with bearing rollers is formed, which protrudes outward from the underside of bearing plate 3 around the central opening 33 such that it fits and projects into the central opening 22 in the base plate. For this purpose, one half radial bearing bushing is formed on each of plate segments 3*a*, 3*b*, in which bearing rollers are rotatably arranged about an axis parallel to the axis of central opening 33 of bearing plate 3. The bearing rollers are thus arranged concentrically along a circle having a radius which is smaller than the radius of central opening 22 in base plate 2. The outer contours of the bearing rollers of radial bearing 34 are chosen such that when the bearing plate is mounted on the base plate, the radial bearing protrudes into central opening 22 of base plate 2 so that the two plate segments 3*a*, 3*b* abut against one another at their abutting faces, forming bearing plate 3.

Each of the plate segments 3*a*, 3*b* of bearing plate 3 is configured as a bearing cage having a plurality of bearing rollers 34 that protrude outward from the plane of the plate on the underside of bearing plate 3. Each bearing cage, as is clear from FIG. 2, forms a plurality of radially extending rows 35 of through openings 36, arranged one behind the other and spaced from one another. In the respective through openings 36, bearing rollers 34 are mounted such that a rolling surface of each protrudes from the underside of bearing plate 3. As is further clear from FIG. 2, bearing rollers 34 arranged one behind the other in a row are each mounted on a shaft 37 installed in the radial direction. For this purpose, a respective bearing channel 34*a* extends through each row of through openings 36, which are arranged one behind the other and spaced apart from one another, into which channel a corresponding shaft 37 can be inserted.

As is further clear from FIGS. 1 to 3, the length of a plurality of the shafts 37 is such that they protrude beyond the edge face 39 of bearing plate 3 and form a bearing plate-side transmission device 30.

In other words, this means that the ten shaft sections 37*a* shown in FIG. 3 make up a part of transmission device 20, 30 on which a manual ratchet 50 is mounted in order to achieve rotation of rotary table 1, as will be described further below. In an alternative embodiment of the invention, in place of the extended shafts 37 bolt sections may be mounted on the edge face 39 of bearing plate 3, to with a manual ratchet 70 can then be attached.

In the present exemplary embodiment, a cover plate comprising two plate segments 4*a*, 4*b* is further provided, which is likewise configured with a central opening, more specifically with a central opening 40. Located on cover plate 4 is a support plate 5 having a central opening 50, which, as is clear from FIG. 3, extends up to the edge of support plate 5 and has an opening width that corresponds to the diameter of central opening 50 of support plate 5. In this way, a substantially U-shaped plate is obtained, which can be easily installed around a drill bit that extends through central opening 50. Further provided is a clamping device 60, which is mounted on one of the protruding shaft sections 37*a* of a shaft 37. This clamping device can be used as a rotation lock in that, once a desired rotational position of the bearing plate relative to the base plate is reached, the clamping device 60 is rotated until a nose protrudes into a tooth 20*a* of the base plate-side transmission device 20, blocking further rotation.

An intended rotation of bearing plate 3 relative to base plate 2 can be accomplished using a manual ratchet 70, as shown in FIGS. 1 to 3. Manual ratchet 70 is equipped with a lever arm 71 and a ratchet member 72 to which a ratchet tooth 73 is attached. Rotation about the axis A shown in FIG. 2, which is induced by actuating lever arm 71 of manual ratchet 70, causes ratchet tooth 73 to engage in one of the teeth 20*a* and to be displaced by a certain angle of rotation with further actuation of the lever arm. Thus, with ratcheting movements induced by the manual ratchet, bearing plate 3 can be rotated relative to base plate 2 by a desired angle of rotation, and once the desired rotational position of bearing plate 3 is reached, said bearing plate can be secured to prevent rotation by means of clamping element 60.

Mounted on support plate 5 is a lifting device 6 consisting of two lifting cylinders 6*a*, 6*b*, which are arranged symmetrically to central opening 50 of support plate 5. Said device can be used to manipulate a workpiece upward or downward relative to the supporting plane of support plate 5.

With the described embodiments of the present invention, it is possible to selectively manipulate a workpiece to adjust its rotational and height position by simple means, whereby even loads of around 30 tons can be manipulated using only the manual ratchet.

The invention is not restricted to the preferred embodiment examples described above. A number of variants are conceivable that make use of the described solution even in fundamentally different configurations. For instance, it is conceivable for cover plate 4 to be dispensed with and/or for support plate 5 to be omitted and other options for supporting the lifting device to be used.

The invention claimed is:

1. A rotary table for positioning a workpiece by means of a manual drive, said rotary table comprising a base plate having a base plate-side transmission device, and also comprising a bearing plate, mounted rotatably on the base plate and having a bearing plate-side transmission device, which is configured to rotate the bearing plate relative to the base plate by means of a drive, wherein the base plate is formed as a two-part or multi-part component composed of at least two plate segments, and wherein the bearing plate is formed as a two-part or multi-part component composed of at least two plate segments, and wherein a manual ratchet having a lever arm and a ratchet member is further provided, which is mounted on the bearing plate-side transmission device in order to bring the ratchet member in engagement with the base plate-side transmission device by actuating the manual ratchet about a radially extending rotational axis.

2. The rotary table according to claim 1, wherein the base plate is formed from two separate plate segments, which are connected to one another via locking means.

3. The rotary table according to claim 1, wherein the base plate is configured as a cylindrical plate having a central round opening.

4. The rotary table according to claim 1, wherein the plate segments of the base plate and/or the plate segments of the bearing plate are configured as mating plate segments.

5. The rotary table according to claim 1, wherein an at least two-part cover plate having a central opening is provided on the bearing plate.

6. The rotary table according to claim 1, wherein on an underside of the base plate a plurality of feet are mounted, which are cylindrical in shape and which further protrude with at least one foot segment beyond the edge of the base plate.

7. The rotary table according to claim 1, wherein the bearing plate is configured as a cylindrical plate having a central opening.

8. The rotary table according to claim 7, wherein a radial bearing protrudes outward on the underside of the bearing plate around the central opening.

9. The rotary table according to claim 1, wherein above the bearing plate an integral support plate having a central opening is provided, said opening extending to the edge of the support plate with a width that is substantially equal to the diameter of the central opening, resulting in an approximately U-shaped plate overall.

10. The rotary table according to claim 9, wherein on the support plate at least one lifting device is provided, which is arranged symmetrically to the central opening on the support plate.

11. The rotary table according to claim 10, wherein two lifting cylinders are provided.

12. The rotary table according to claim 1, wherein each of the plate segments of the bearing plate is configured as a bearing cage having a plurality of bearing rollers that protrude outward from a plate plane on the underside of the bearing plate.

13. The rotary table according to claim 12, wherein the bearing cage forms a plurality of radially extending rows of through openings, arranged one behind the other and spaced from one another, in which the bearing rollers are respectively mounted.

14. The rotary table according to claim 12, wherein each of the bearing rollers arranged one behind the other in a row is mounted on a shaft, which is installed in a radial direction and which extends up to an edge face of the bearing plate, and which protrudes outward on the face side from the bearing plate with face-side shaft sections.

15. The rotary table according to claim 14, wherein the bearing plate-side transmission device is formed at least partially by shaft sections of the shaft or bolts protruding from the face side of the bearing plate.

16. The rotary table according to claim 15, wherein a manual ratchet is mounted to said bolt protruding from the face side of the bearing plate.

* * * * *